US006962198B2

(12) United States Patent
Gao

(10) Patent No.: US 6,962,198 B2
(45) Date of Patent: Nov. 8, 2005

(54) GROUNDWATER WELL SAMPLE DEVICE

(76) Inventor: Xiangjing Gao, 4780 Byers Rd., Alpharetta, GA (US) 30022

( * ) Notice: Subject to any disclaimer, the term of this patent is extended or adjusted under 35 U.S.C. 154(b) by 154 days.

(21) Appl. No.: 10/644,920

(22) Filed: Aug. 21, 2003

(65) Prior Publication Data

US 2005/0039909 A1 Feb. 24, 2005

(51) Int. Cl.[7] ..... E21B 47/00
(52) U.S. Cl. ..... 166/264; 166/162; 73/864.63
(58) Field of Search ..... 166/264, 162, 166/168; 16/428; 40/673; 248/320, 323, 248/327, 328, 329; 73/864.51, 864.63; 24/128, 24/130; 220/751, 754, 759

(56) References Cited

U.S. PATENT DOCUMENTS

| | | | | |
|---|---|---|---|---|
| 2,381,698 A | * | 8/1945 | Sireci | 33/392 |
| 2,538,927 A | * | 1/1951 | Truitt | 40/315 |
| 3,636,594 A | * | 1/1972 | Faivre | 24/298 |
| 4,590,810 A | | 5/1986 | Hunkin et al. | |
| 4,625,574 A | | 12/1986 | Robbins | |
| 5,139,654 A | | 8/1992 | Carpenter | |
| 5,307,695 A | * | 5/1994 | Sawchuk | 73/864.51 |
| 5,507,194 A | * | 4/1996 | Scavuzzo et al. | 73/864.63 |
| 5,597,966 A | | 1/1997 | Timmons | |
| 5,753,831 A | | 5/1998 | Mohs | |
| 6,167,962 B1 | | 1/2001 | Pratt | |
| 6,272,938 B1 | * | 8/2001 | Baghel et al. | 73/863.23 |
| 6,276,220 B1 | | 8/2001 | Varhol | |

FOREIGN PATENT DOCUMENTS

GB 2351456 * 3/2001 ..... A63H 33/10

* cited by examiner

*Primary Examiner*—William Neuder
(74) *Attorney, Agent, or Firm*—Richard C. Litman

(57) ABSTRACT

The groundwater well sample device is an elongated, cylindrical sample tube, having a top end and a bottom end. The top end is open. A knothole is formed through the wall of the sample tube near the top end. The knothole is large enough for the knotted end of a string to be easily passed through the knothole. A zigzagging string-retaining slot is formed through the sample tube wall, extending from the knothole toward the top end of the sample tube. The string-retaining slot is slightly narrower than the diameter of a string. The string-retaining slot terminates in a stress-reducing aperture. In use, the knotted end of a string is passed through the knothole, and the string then pulled into the string-retaining slot where the string, slightly compressed within the slot, is held tightly in place. The top end is angled to allow easy access to the string-insertion aperture.

5 Claims, 3 Drawing Sheets

GROUNDWATER WELL SAMPLE DEVICE

BACKGROUND OF THE INVENTION

1. Field of the Invention

The present invention relates generally to bailers for sampling groundwater. More specifically, the present invention is a groundwater well sampling device that decreases spillage when emptying the device, that is simple to securely attach to a string for use, that is easy to use, and that reduces manufacturing costs.

2. Description of the Related Art

Groundwater sampling devices, commonly known as "bailers", are widely used to take groundwater samples from underground wells, or surface water sources, for testing. Bailers are typically elongated cylindrical devices with an open top. A string is tied to the top of the bailer, and the bailer is lowered by the string into a well or surface water source to collect a water sample. Once the sample is retrieved, it is usually poured from the bailer into a sample jar.

Conventional bailers have a handle disposed across the top of the bailer to which the string is attached. The string is looped around the handle and tied, often with several knots to secure the string to the bailer's handle. U.S. Pat. No. 6,276,220, issued on Aug. 21, 2001 to B. Varhol, illustrates such a bailer having a handle structure at the top end of the bailer for attaching a string. U.S. Pat. No. 4,590,810, issued on May 27, 1986 to G. Hunkin et al., U.S. Pat. No. 4,625,574, issued on Dec. 2, 1986 to R. Robbins, U.S. Pat. No. 5,139,654, issued on Aug. 18, 1992 to R. Carpenter, U.S. Pat. No. 5,597,966, issued on Jan. 28, 1997 to R. Timmons, U.S. Pat. No. 5,753,831, issued on May 19, 1998 to C. Mohs, and U.S. Pat. No. 6,167,962, issued on Jan. 2, 2001 to D. Pratt, each illustrate bailers with a handle or handle-like structure at the top of the bailer for securing a string.

The handle top of a conventional bailer presents several problems. The handle top is often a molded plastic part, manufactured separately from the body of the bailer. The manufacturing cost of this handle top piece contributes to a significant portion of the cost of the bailer. Additionally, because the handle is located over the opening of the bailer, the handle often causes spillage when emptying the bailer as the collected fluid splashes around the handle. Spillage can cause loss of the sample, requiring the sample to be retaken. Additionally, spillage can cause contamination of sampling equipment, other samples, and even the environment if the sample collected is from a contaminated water source. Furthermore, the task of tying the string to the bailer can be time consuming, and difficult, since the person using the bailer typically wears protective gloves. It is often necessary to tie several knots to secure the bailer, especially if the line used is a nylon line that can be slippery and prone to un-tying. Should the knot work loose, the bailer may be lost into the well or water source being sampled.

None of the above inventions and patents, taken either singly or in combination, is seen to describe the instant invention as claimed. Thus, a groundwater well sample device solving the aforementioned problems is desired.

SUMMARY OF THE INVENTION

The groundwater well sample device eliminates the handle top used by conventional bailers, and provides a secure attachment for a string used to lower the groundwater well sample device into a well.

The groundwater well sample device includes a sample tube similar to conventional bailers. The sample tube is an elongated, hollow cylinder having top and bottom ends. The bottom end is adapted for receiving and retaining a fluid sample within the sample tube, in any manner common to conventional bailers.

The top end of the sample tube has a unique structure that reduces manufacturing costs and makes the bailer easy to use. A knothole is formed through the wall of the sample tube below and in vertical alignment with the string-retaining aperture. The knothole has a diameter large enough for the knotted end of the string to be easily passed through the knothole.

A narrow string-retaining slot is formed through the wall of the sample tube, extending from the knothole and terminating in a stress-relieving aperture. The slot is sharply zigzagged, so that the string is prevented from sliding back down the slot to the knothole. The stress-relieving aperture that terminates the slot reduces stress concentration at the end of the slot. Thus, a knotted end can be inserted through the knothole, and the string pulled into the string-retaining slot where the string is retained securely in place by the string-retaining slot.

The top end of the sample tube is angled to allow easy access to the string insertion hole, to allow a string to be easily affixed to the groundwater well sample device.

Because there is no handle or other obstruction across the top of the sample tube, there is a minimal risk of splashing or spillage as the groundwater well sample device is emptied.

Accordingly, it is a principal object of the invention to provide a groundwater well sample device that is inexpensive to manufacture and easy to use.

It is another object of the invention to provide a groundwater well sample device that is easily affixed to a string for lowering the device into and raising the device from a well or fluid sample source.

It is a further object of the invention to provide a groundwater well sample device that resists coming loose from a string that is attached for lowering the device into and raising the device from a well or fluid sample source.

Still another object of the invention is to provide a groundwater well sample device that can be emptied without risk of splashing or spillage of the fluid sample.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
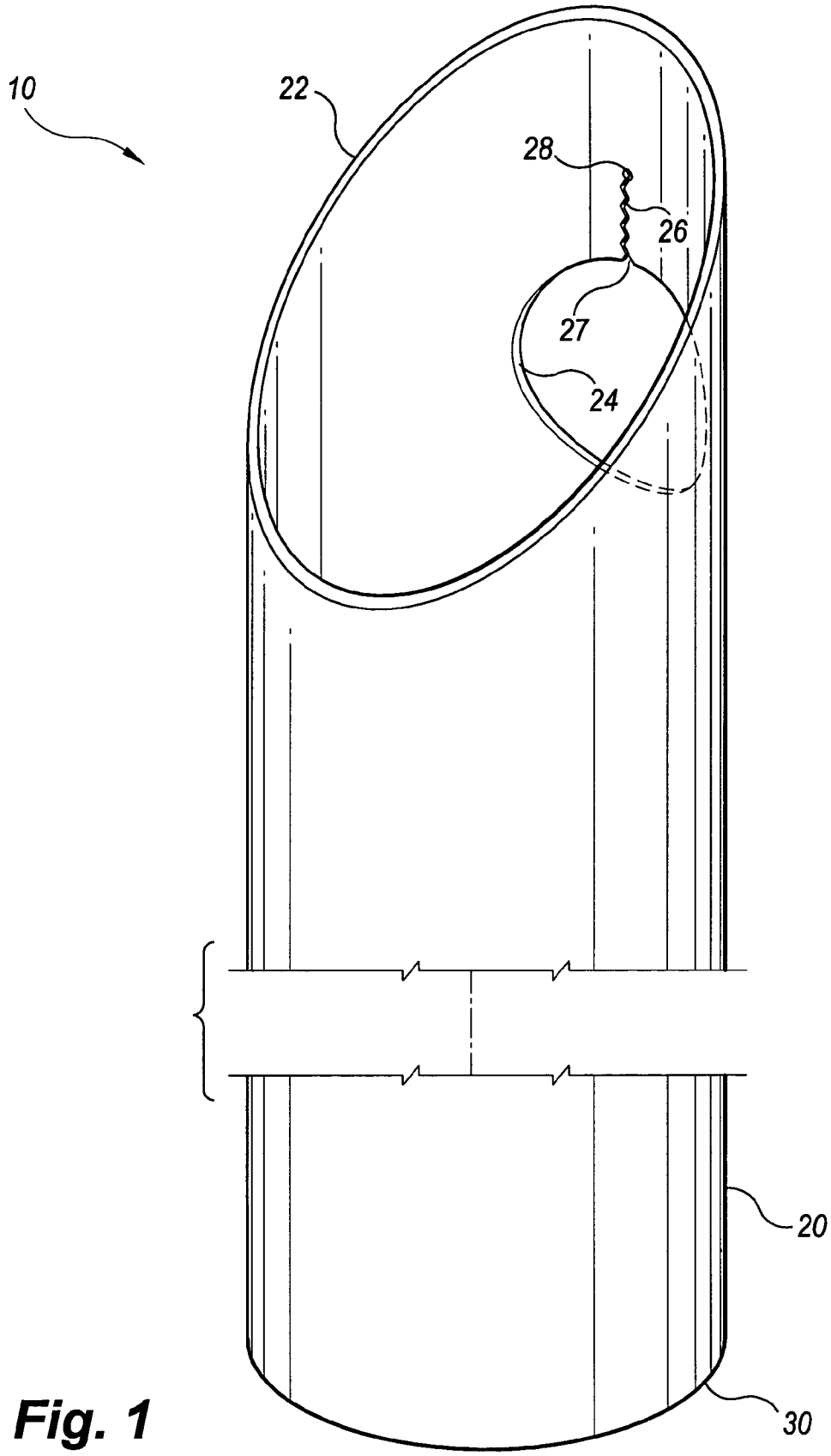
FIG. 1 is a perspective view of a groundwater well sample device according to the present invention.
Figure 2:
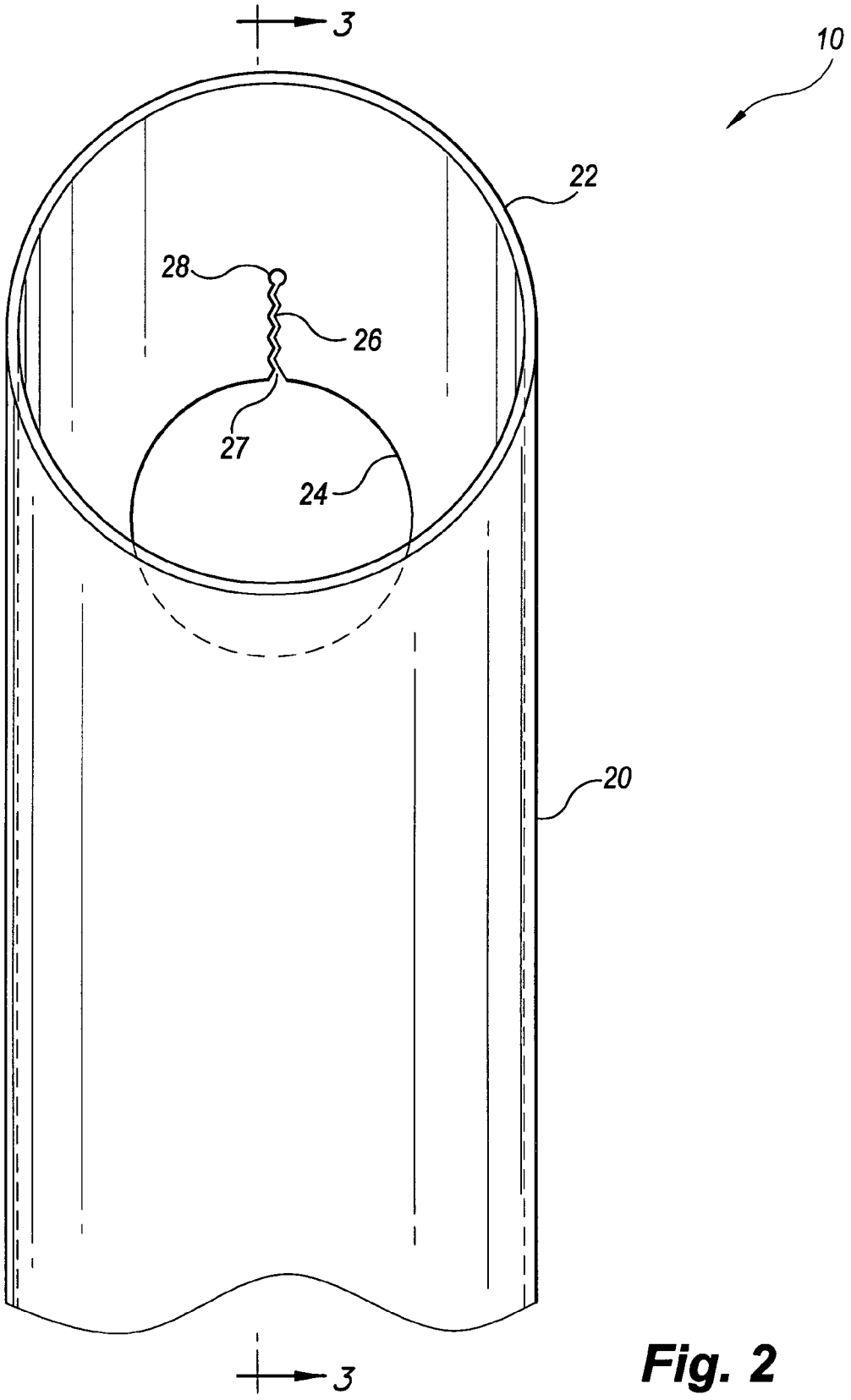
FIG. 2 is a fragmented, front elevational view of the top end of the groundwater well sample device shown in FIG. 1.
Figure 3:
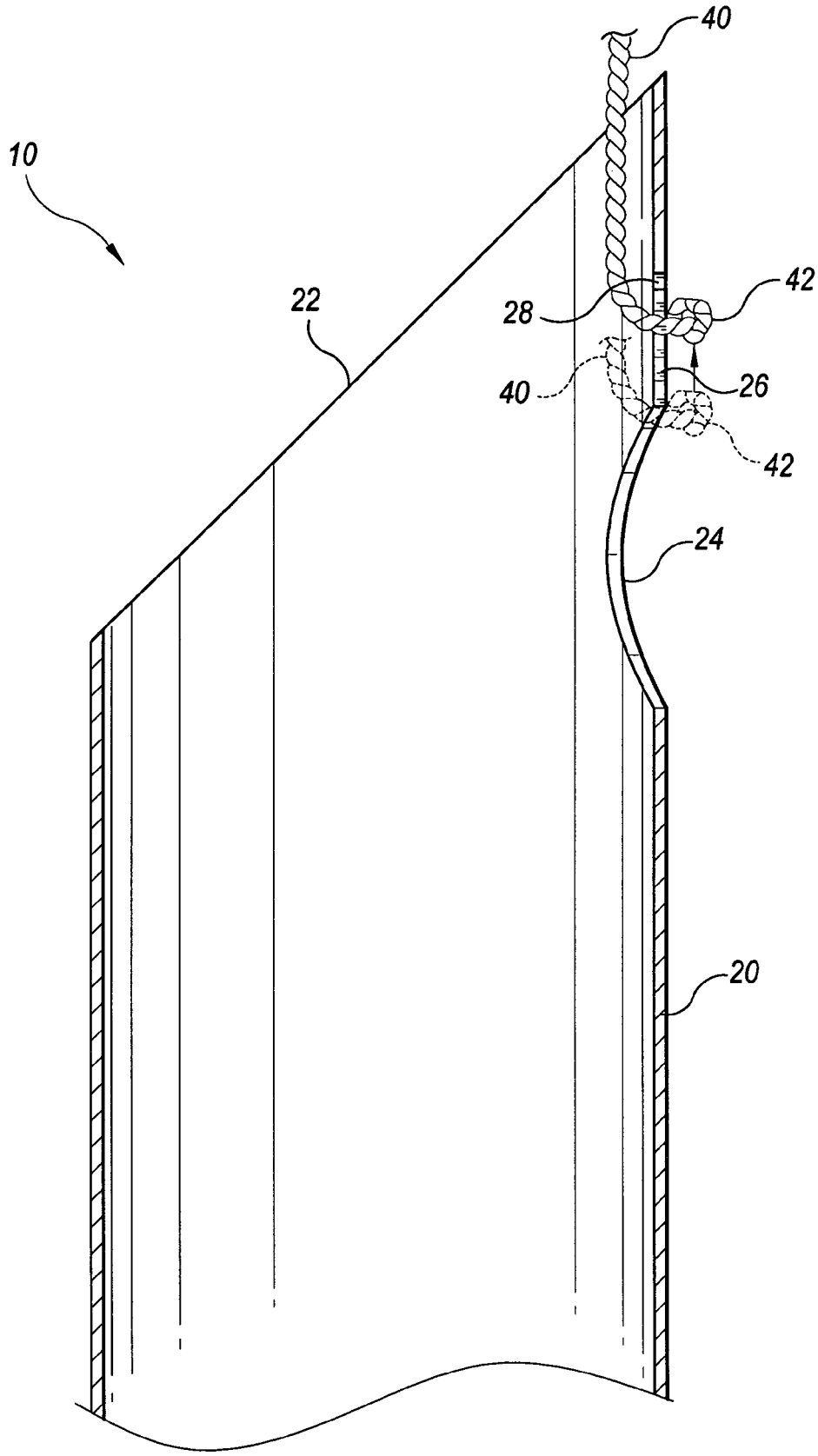
FIG. 3 is a section view drawn along lines 3—3 of FIG. 2.

The present invention is a groundwater well sampling device, designated generally as 10 in the drawings.

Illustrated generally in FIG. 1, the groundwater well sampling device 10 comprises a sample tube 20, having a top end 22 and a bottom end 30. The sample tube 20 is an elongated, hollow, cylindrical tube. The top end 22 is open. A retaining means for retaining water within the sample tube 20 may be disposed on the bottom end 30. The retaining means may be an end cap attached to, or a bottom wall member formed in, the bottom end 30. Preferably, an admitting and retaining means for admitting a fluid sample into, and retaining the fluid sample within, the sample tube 20 is disposed on the bottom end 30. The admitting and retaining means is preferably a check-valve structure. U.S. Pat. Nos. 4,590,810, 4,625,574, 5,597,966, 6,167,962, and 6,276,220 illustrate and teach various admitting and retaining means for bailers, and these patents are incorporated herein by reference in their entirety.

A knothole 24 is formed through the wall of the sample tube 20 near the top end 22. The knothole 24 has a diameter large enough to permit the knotted end of the string 40 to be easily passed through the knothole 24.

A narrow string-retaining slot 26 is formed through the wall of the sample tube 20, extending from the knothole 24 toward the top end 22 of the sample tube 20. The slot 26 has a width slightly smaller than the diameter of the string 40. In use, the string 40 is inserted through the tube 20 with one end inside the tube 20 and the other end outside the tube 20, the string 40 then being pulled into the string-retaining slot 26. The string 40 compresses slightly as it is drawn into the slot 26, leaving the slot 26 tightly gripping the string 40.

The slot 26 is sharply zigzagged, so that the knotted end 42 of the string 40 does not slide down to the level of the knothole 24, where the knot 42 might slip back through the knothole 24. A chamfer 27 formed in the slot 26 where the slot 26 joins the knothole 24 facilitates insertion of the string 40 into the slot 26.

The top end of the slot 26 terminates in a stress-relieving aperture 28. The stress-relieving aperture 28 reduces stress concentrations at the end of the slot 26.

The top end 22 of the sample tube 20 is angled to allow easy access to the knothole 24, providing for easy attachment of the string 40 to the groundwater well sampling device 10.

Because no handle or other structure obstructs the top end 22 of the sample tube 20, a fluid sample can be readily emptied from the groundwater well sampling device 10 with a minimal risk of splashing or spillage.

It is to be understood that the present invention is not limited to the embodiment described above, but encompasses any and all embodiments within the scope of the following claims.

I claim:

1. A groundwater well sample device, comprising:

a sample tube, the sample tube being an elongated hollow cylinder, the sample tube having an open top end and a closed bottom end adapted for containing a groundwater sample, the tube further having:

a knothole defined therein adjacent to the top end;

a string-retaining slot defined therein extending from the knothole towards the top end, the string-retaining slot having a knothole end and a terminal end; and a stress-reducing aperture defined therein, the stress-reducing aperture adjoining said terminal end of said string-retaining slot;

wherein the top end of said tube is angled, and the tube being open opposite the knothole, whereby a knotted end of a string may be passed through the knothole without passing into the cylinder defined by the tube.

2. The groundwater well sample device according to claim 1, wherein said slot is zigzagged.

3. The groundwater well sample device according to claim 1, further comprising a retaining means for retaining a fluid within said sample tube, the retaining means being disposed on said bottom end of said sample tube.

4. The groundwater well sample device according to claim 1, further comprising an admitting and retaining means for admitting a fluid sample into and retaining the fluid sample within said sample tube, the admitting and retaining means disposed on said bottom end of said sample tube.

5. A groundwater well sample device comprising:

a sample tube, the sample tube being an elongated hollow cylinder, the sample tube having an open top end and a closed bottom end adapted for containing a groundwater sample, the tube further having:

a knothole defined therein adjacent to the top end;

a string-retaining slot defined therein extending from the knothole towards the top end, the string-retaining slot having a knothole end and a terminal end;

a stress-reducing aperture defined therein, the stress-reducing aperture adjoining said terminal end of said string-retaining slot; and wherein the string-retaining slot has a chamfer formed in the knothole end.

* * * * *